US006053261A

United States Patent [19]

Walter

[11] Patent Number: 6,053,261

[45] Date of Patent: Apr. 25, 2000

[54] FLOW PULSING METHOD AND APPARATUS FOR THE INCREASE OF THE RATE OF DRILLING

[76] Inventor: Bruno H. Walter, c/o Waltech Design Group Inc., 299 E. Braemar Rd., North Vancouver, Canada, V7N 1R2

[21] Appl. No.: 09/262,815

[22] Filed: Mar. 5, 1999

Related U.S. Application Data

[63] Continuation of application No. 08/844,446, Apr. 18, 1997, abandoned.

[30] Foreign Application Priority Data

Apr. 29, 1996 [CA] Canada ..... 2175296

[51] Int. Cl.[7] ..... E21B 21/10

[52] U.S. Cl. ..... 175/234; 175/243

[58] Field of Search ..... 175/231, 232, 175/234, 243, 296, 297, 107, 317

[56] References Cited

U.S. PATENT DOCUMENTS 4,817,739 4/1989 Jeter .
4,819,745 4/1989 Walter .
4,830,122 5/1989 Walter .
4,905,778 3/1990 Jurgens .
4,979,577 12/1990 Walter .
5,190,114 3/1993 Walter .

*Primary Examiner*—William Neuder
*Attorney, Agent, or Firm*—Killworth, Gottman, Hagan & Schaeff, LLP

[57] ABSTRACT

A simple and economical device is placed in a drill string to provide a pulsating flow of the pressurized drilling fluid to the jets of the drill bit to enhance chip removal and provide a vibrating action in the drill bit itself thereby to provide a more efficient and effective drilling operation. Operation of the device is such that a pronounced negative pulse precedes the positive pulse. Between pulses there is a short time delay and this feature will further enhance drilling rates. Device automatically bypasses all fluid if it is disabled.

13 Claims, 6 Drawing Sheets

FLOW PULSING METHOD AND APPARATUS FOR THE INCREASE OF THE RATE OF DRILLING

This application is a continuation of Ser. No. 08/844,446 filed Apr. 18, 1997 abandoned.

This invention relates to flow pulsing methods and apparatus for use in various applications, such as in down-hole drilling equipment and in particular to an improved flow pulsing method and apparatus of this type adapted to be connected in a drill string above a drill bit with a view to securing improvements in the drilling process.

In the patent issued to Bruno H. Walter U.S. Pat. No. 4,819,745 issued Apr. 11, 1989 there is described in detail the classical rotary drilling method and the manner in which drilling fluid or drilling mud is pumped down ward through the hollow drill string with the drilling mud cleaning the rolling cones of the drill bit and removing or clearing away rock chips from the cutting surface and then lifting and carrying such rock chips upwardly along the well bore to the surface. That patent discusses the effect of jets on the drill bit to provide high velocity fluid flows near the bit. In general, these jets serve to increase the effectiveness of drilling, i.e. they increase the penetration rate.

The above U.S. Patent also describes the use in the drill string of vibrating devices thereby to cause the drill string to vibrate longitudinally, which vibrations are transmitted through the drill bit to the rock face thus increasing the drilling rate somewhat. These prior art devices were subject to a number of problems as noted in the above U.S. Pat. No. 4,819,745.

More recent forms of apparatus for increasing the drilling rate by periodically interrupting the flow to produce pressure pulses therein and a water-hammer effect which acts on the drill string to increase the penetration rate of the bit are described in my U.S. Pat. No. 4,830,122 issued May 16, 1989. These devices (incorporating axially movable valve members) have provided a significant improvement over the known prior art rotary valve arrangements and have been less prone to jamming and seizing as the result of foreign matter in the drilling fluid. At the same time there was a requirement for higher pump operating pressures and therefore these devices have not been able to be implemented on a majority of drilling rigs.

A subsequent design of the flow pulsing apparatus described in my U.S. Pat. No. 5,190,114 relies on the interruption of the flow by a member operated by the reduction of the pressure due to the Bernoulli Effect in the area under the movable member. This design works very efficiently when the drilling fluid is water. However at greater depth when the heavier drilling fluid is used, the restricting member can stabilize and the effectiveness of the system is reduced.

In all the above mentioned devices the restricting member would start to open immediately following closure.

It has been learned since that it would be desirable to produce a pressure pulse below the bit with a more pronounced negative phase and a short delay between pulses. This characteristics can increase the amount of cleaning action.

In view of the above it would be very desirable to provide flow pulsing apparatus for the use in the drill string which would operate reliably under any down hole conditions with heavy and light drilling mud and at the same time provide a time delay between negative and positive phase of the pressure pulse.

SUMMARY OF THE INVENTION

It is a general object of the present invention to provide improved flow pulsing methods and apparatus for various applications wherein vibrating and/or flow pulsing effects are desired, for example, vibrating a drill string and a drill bit to increase the drilling rate and to pulse the flow of drilling fluid emitting from the drill bit jets thereby to enhance the cleaning effect and the drilling rate. A further object of the invention is to provide apparatus that would assure positive closure of the restricting member regardless of the mud density and its subsequent opening. An additional objective is to provide apparatus that would allow the continuation of the drilling process without the benefit of the pulsating flow, in the event that the restricting member fails in operation and remains in the closed position.

Accordingly, the invention in one aspect provides a flow pulsing apparatus including a housing providing a passage for a main flow of fluid, and a bypass flow of fluid through a jet pump arrangement that is at the top part of the main flow passage, and means for periodically interrupting the flow through main passage to create pulsations in the flow with a time delay between pulses and a cyclical water-hammer effect to vibrate the drill string during use. In particular, the main flow passage includes a valve that is constantly urged upward by a spring or other means. Flow around this valve is at such velocity that, due to the Bernoulli effect, pressure is reduced between the valve and the valve seat. This differential pressure acts on a projected area of the valve and the valve is positively closed. The resulting water-hammer pressure assures positive closure. Pressure below the suddenly closed valve is reduced to the hydrostatic pressure while pressure above the closed valve is at the water-hammer pressure. Immediately, following the closure of the valve, energy in the fast flowing fluid through the drill bit jets causes evacuation of a small amount of drilling fluid from the area under the closed valve. This effect reduces the pressure in the affected area below the hydrostatic pressure (for a fraction of time) and cleaning action on the bottom of the drilled hole is further enhanced.

The resulting force on the valve is much greater than the continuous force that urges the valve constantly upward by a spring or other means. Water-hammer pressure now travels upward at the speed of sound in the particular fluid until it reaches the jet pump arrangement. Once the water-hammer pressure increase reaches the jet pump arrangement it continues upward through the main flow passage and through the drill string section. At the same time water hammer pressure increase travels at the speed of sound around the main flow passage into the bypass flow passage downward until it reaches the bottom part of the closed valve. Following a short time delay, pressure under the closed valve and pressure above the closed valve are at the same water-hammer pressure and the valve is now urged upward by the compressed spring or other means. The cycle is now repeated.

The invention also includes a flow pulsing method including the basic actions noted above. The novel method allows for a time delay between pulses and also a more pronounced negative pulse that precedes the positive pulse for the purpose of better disturbing bottom hole conditions and improving the hole cleaning.

In the preferred form of the invention the flow pulsing apparatus is adapted to be connected in a drill string above a drill bit to "pulse" the flow of drilling fluid passing toward the bit thereby to vibrate the drill bit and enhance the hole bottom cleaning effect, thus increasing the drilling rate.

In the embodiment to be described hereafter the control means takes a form of a valve that is urged by a spring or by other means upward from the valve seat and arrangement of the main flow passage above the valve means to allow for the water-hammer pressure pulse to exit through the jet pump arrangement into the bypass flow passage and to continue down until it reaches under the valve means to equalize the pressure above and under the valve.

The invention will be better understood from the following description of preferred embodiments of same, reference being had to the accompanying drawings.

BRIEF DESCRIPTION OF THE VIEWS OF DRAWINGS

DETAILED DESCRIPTION OF THE PREFERRED EMBODIMENTS

Figure 1:
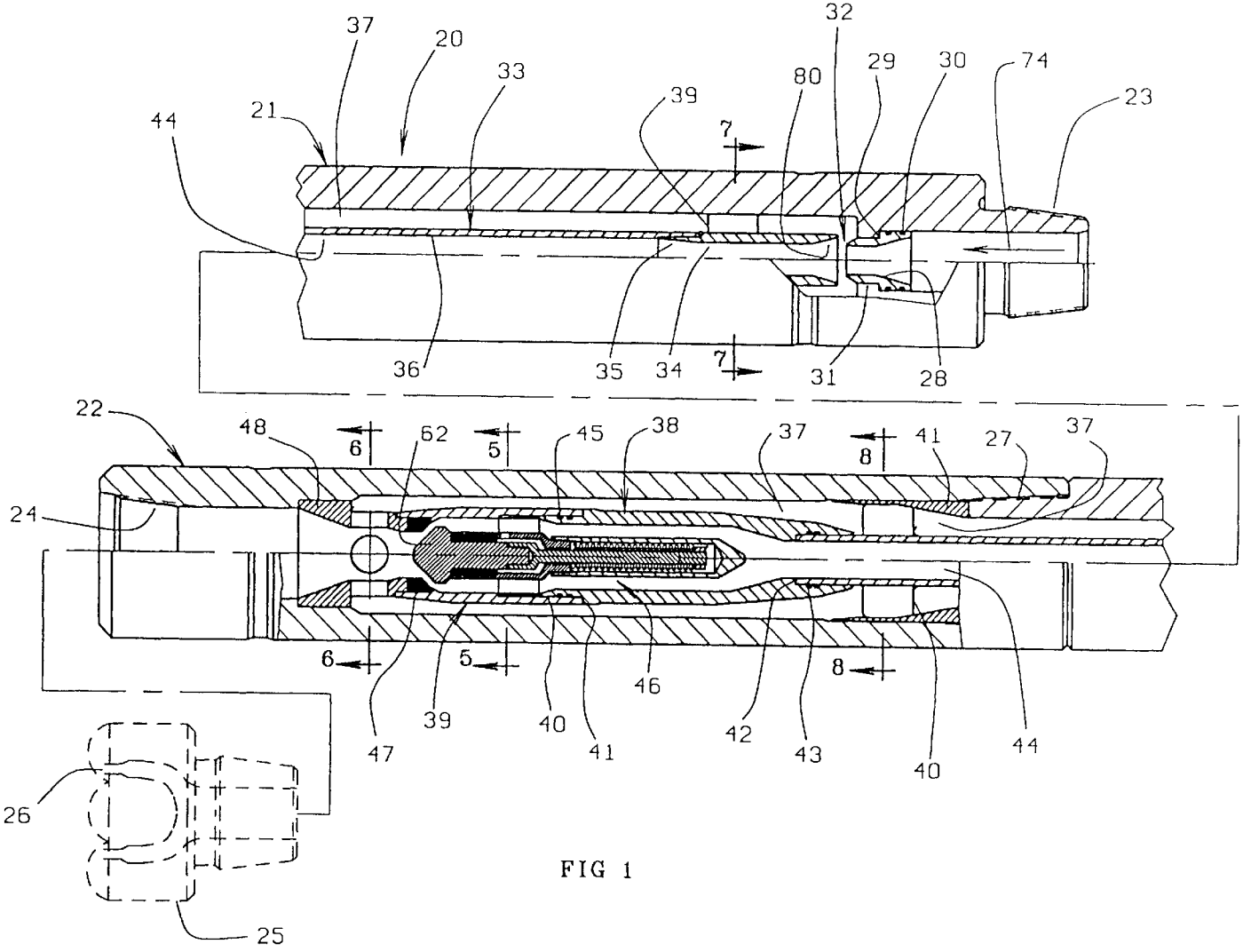
FIG. 1 is a longitudinal section through an apparatus for producing high frequency pulses in the drilling fluid in accordance with a preferred embodiment of the invention.

Referring to FIGS. 1–8 a preferred embodiment of the invention is shown in detail. The apparatus 20 includes an external tubular housing (defining a primary flow passage) including upper housing 21 and lower housing 22. Upper housing 21 has an externally threaded portion 23 for connection to the lower end of the drill string (not shown), while lower housing 22 has an internally threaded portion 24 for connection to a conventional drill bit 25 (shown in phantom) having conventional bit jets 26 for bottom hole cleaning as noted previously.

The lower housing 22 is connected to the upper housing 21 via tapered threaded portions 27.

In the upper portion of the upper housing 21 is located a velocity increasing nozzle 28. Nozzle 28 is supported by a ledge 29 and a seal arrangement by "O" rings 30 prevents leakage of the drilling fluid around the cylindrical portion 31.

Accelerated flow of the drilling fluid exiting nozzle 28 enters a jet pump arrangement 32 of the wash pipe 33. Main flow passage is through the tapered entrance 80 and is defined by the Internal Diameter 34. Flow than continues through the diffuser like passage 35 to a passage with the enlarged Internal Diameter 36.

Jet pump action of the accelerated flow exiting from the nozzle 28 and entering the upper portion 80 of the wash pipe 33 will create a weak suction of the fluid from the area 37 surrounding the wash pipe 33 and the valve housing 38.

Figure 7:
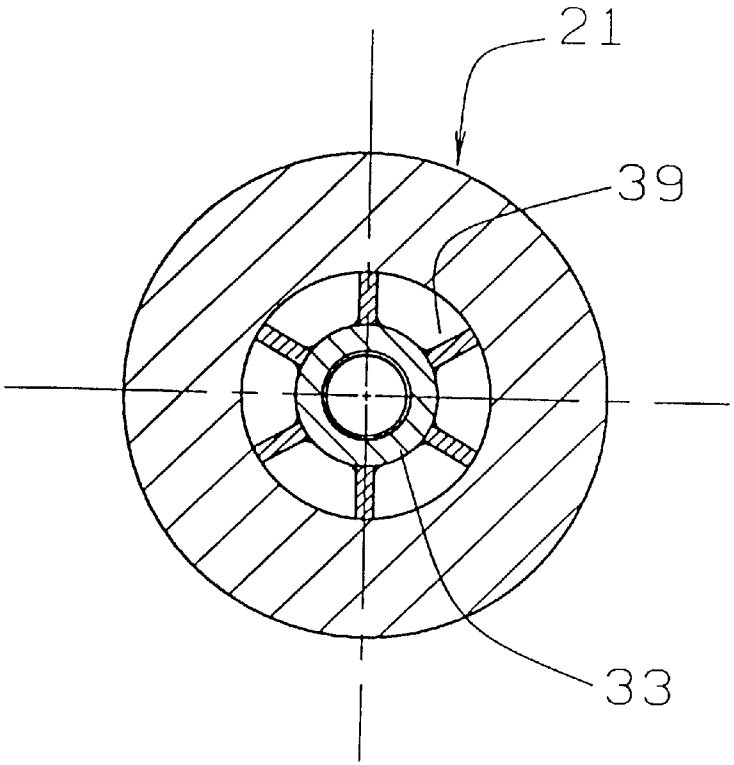
FIG. 7 is a cross-section view taken along line 7—7 of FIG. 1.

Wash pipe 33 is kept in the center of the upper housing 21 by welded ribs 39 which are more clearly shown on the FIG. 7. Wash pipe 33 is kept in the center of the lower housing 22 by welded ribs 40 which are more clearly shown on the FIG. 8. Welded ribs 40 are in contact with the Internal Diameter of the sleeve 41. This sleeve 41 streamlines the bypass flow passage 37. Bottom portion of the wash pipe 33 is inserted into the top opening of the valve housing 38 and is resting on the shoulder 42. Seal between the main flow passage and bypass flow passage is provided by "O" rings 43.

Valve housing 38 is inserted into a valve seat housing 39 at the reduced diameter cylindrical portion 40 and is resting on the shoulder 41. Seal between the main flow passage 44 and bypass flow passage 37 is maintained by "O" rings 45. In the valve seat housing 39 is inserted valve assembly 46, base ring 48 and heat shrink fitted a tungsten carbide valve seat 47. Valve assembly is more clearly shown on FIG. 2. and FIG. 5 where cross-section through the line 5—5 is shown.

Figure 2:
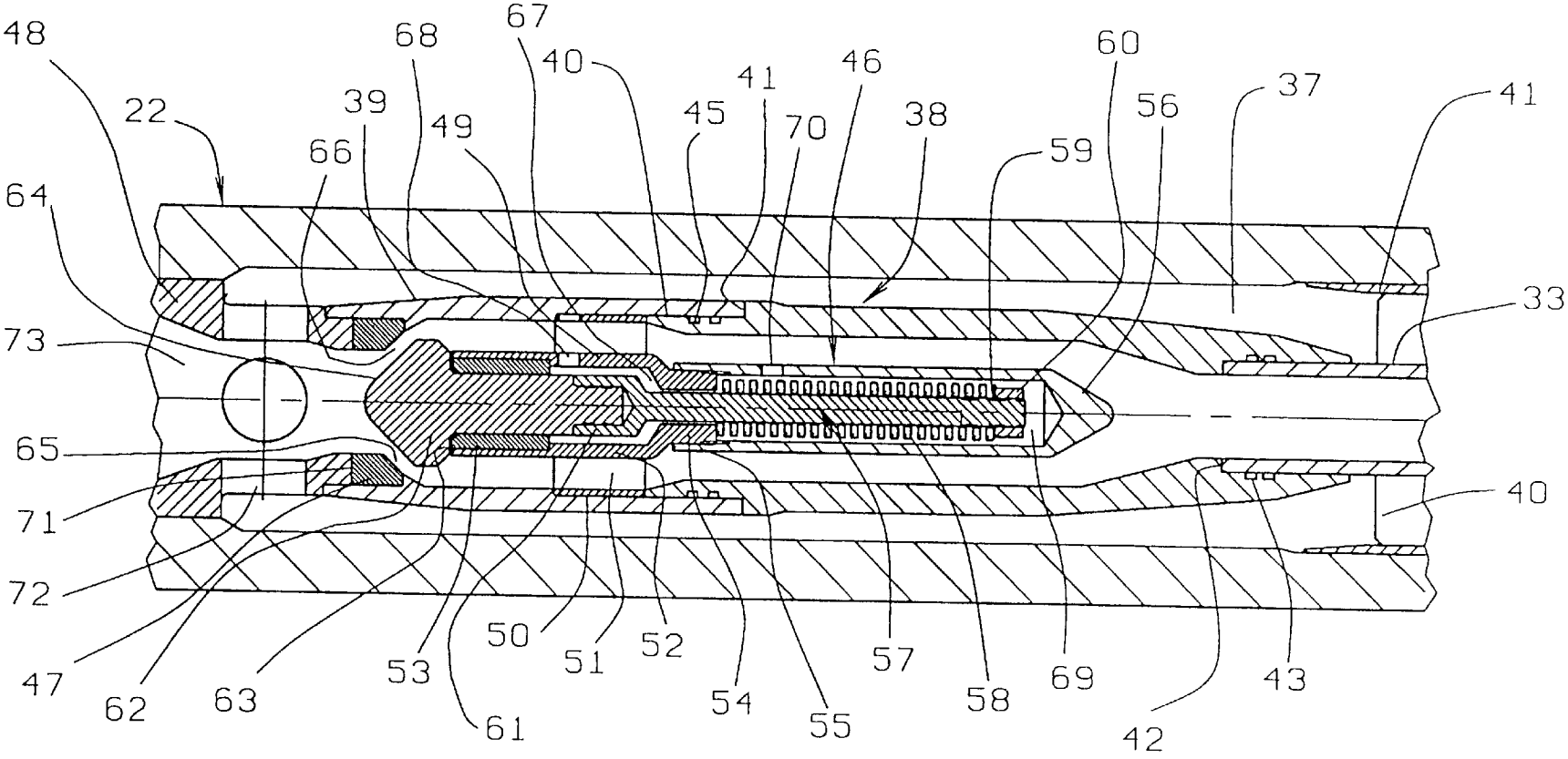
FIG. 2 is an enlarged portion of the FIG. 1 showing the flow pulsing means in further detail.

On FIG. 2 valve assembly 46 consist of a "spider" 49 which has a cylindrical portion 50 that is inserted into the valve seat housing 39. "Spider" 49 has flow passages 51 shown on FIG. 5 and FIG. 2 and in its center a hollow cylindrical portion 52 that surrounds by a heat shrink fit a tungsten carbide valve bearing 53 on the bottom end and on the opposite top end a reduced size pipe like portion 54. On the outside of the portion 54 is a tapered threaded connection 55 with which a spring housing 56 is connected. Through the top portion of the "spider" 49 protrudes a valve puller 57. Around the valve puller 57 is located pre stressed compression spring 58. Spring 58 rests on the top part of "spider" 49 and its top end is continually in contact against face 59 of the epoxy glued nut 60.

Bottom end of the valve puller 57 is an enlarged hollow cylindrical portion 61 which surrounds by heat shrink fit a top end of the tungsten carbide valve 62. This valve 62 is urged upward by a spring 58 and when it is in its most upward position it is prevented from further movement by a shoulder 63.

Main drilling fluid flow through the area 66 that is between the bottom conical surface 64 and the top conical surface of the valve seat 47 is at high velocity. Bernoulli effect reduces the pressure in this fast flow and at the same time creates a pressure loss between area above the valve 62 and below the valve. This differential pressure acting on the projected area of the valve creates a force stronger than the resistant spring force and valve moves down until bottom portion of the valve 64 sets firmly onto top portion of the valve seat 65. Venting of the area 67 is provided by a venting hole 68. Venting of the area 69 is provided by a venting hole 70.

Valve seat 47 is heat shrunk into a valve seat housing 39. Valve seat 47 is resting on top of the base ring 48 cylindrical portion 71.

Base ring 48 is shown in cross-section along line 6—6 shown on FIG. 1 where are shown holes 72 which allow communication between the bypass flow passage and bottom end of the main passage 73.

In operation of the embodiment shown in FIGS. 1–8 the drilling fluid or mud is being pumped downwardly as shown by arrow 74. Flow is accelerated in the nozzle 28 and it continues into the bore of the wash pipe 33. Top portion of the wash pipe 33 is separated a short distance from the bottom end of the nozzle 28 and is produced to resemble a jet pump configuration. This area therefore functions as a jet pump and assures flow through the main flow passage 44 as long as the valve 62 is in its open position as shown on FIG. 3. Action of the jet pump arrangement causes a small flow from the bypass flow passage 37 into the main flow passage 44.

Flow of the drilling fluid continues downwardly and around the valve assembly 46. Flow between the bottom surface 64 of the valve 62 and the top surface 65 of the valve seat 47 is maintained at the high velocity and due to Bernoulli effect pressure in this area is reduced. At the same time after flow passes through this area 66 it experiences a pressure loss.

Valve 62 which is continually urged upward by a spring 58 is now subjected to the differential pressure above the valve 62 and below the valve 62. This differential pressure now acts on the projected area of the valve 62 and resulting force which if far greater then the upward force delivered by spring 58 now causes downward movement of the valve 62 until it reaches a fully closed position as shown on FIG. 4.

When the valve 62 reaches the closed position a water hammer results and all kinetic energy of the flowing drilling fluid directly above the closed valve is converted into pressure rise. This water-hammer pressure now travels upward at the speed of sound in the particular fluid. Below the closed valve 62 pressure is instantly reduced to the hydrostatic pressure and if the small diameter drill bit nozzles are used inertia of the fast flowing fluid through the drill bit nozzles will evacuate some fluid out of the main flow passage 73 resulting in a negative pressure that would be lower than hydrostatic pressure.

When the water-hammer pressure reaches the top portion of the wash pipe 33 it will now continue into the bypass flow area 37 and continue downward until it exits through the holes 72 and under the closed valve 62 and into the bottom part of the main flow passage 73. At the same time water-hammer pressure will also travel upward and into the bore of the drill string that is connected by a threaded connection 23 on the top of the housing 21.

Figure 3:
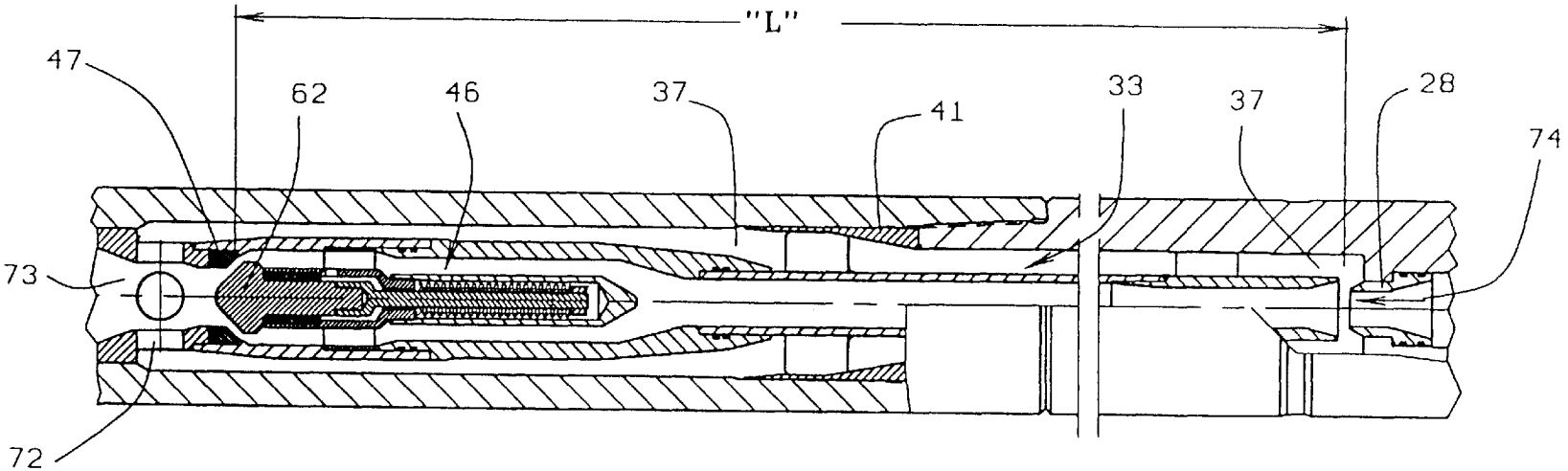
FIG. 3 is showing unrestricted flow pulsing means and the jet pump arrangement situated above.
Figure 4:
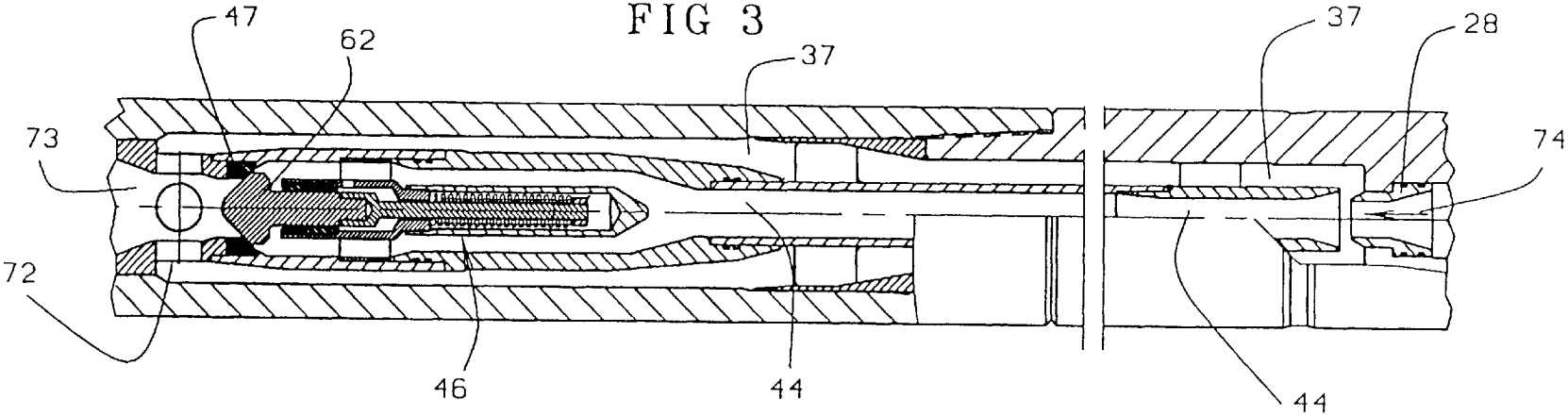
FIG. 4 is showing fully closed flow pulsing means and the jet pump arrangement.
Figure 6:
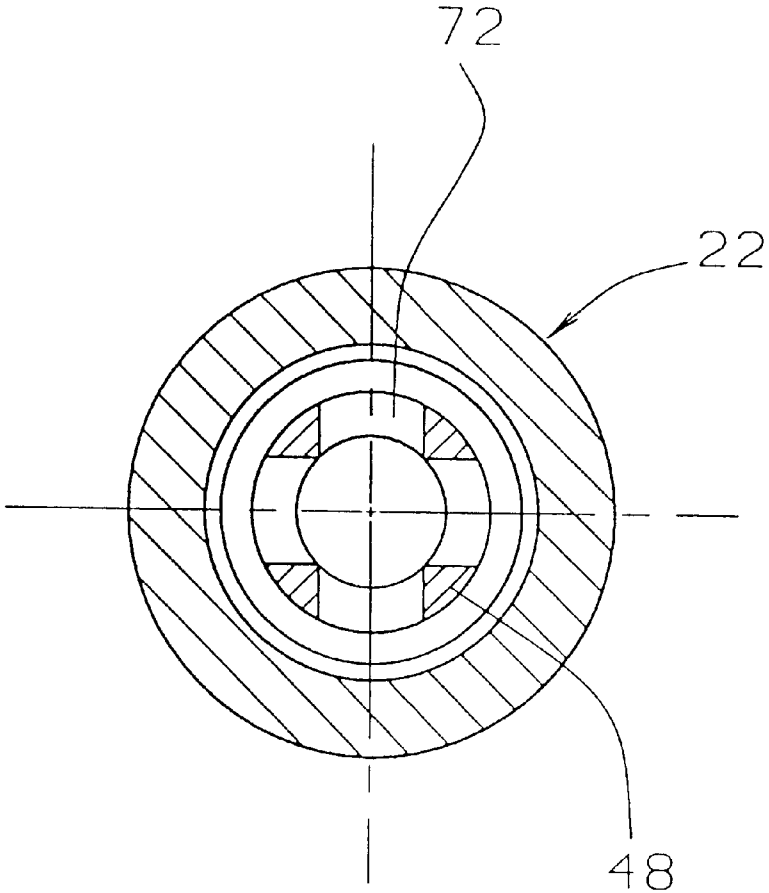
FIG. 6 is a cross-section view taken along line 6—6 of FIG. 1.
Figure 5:
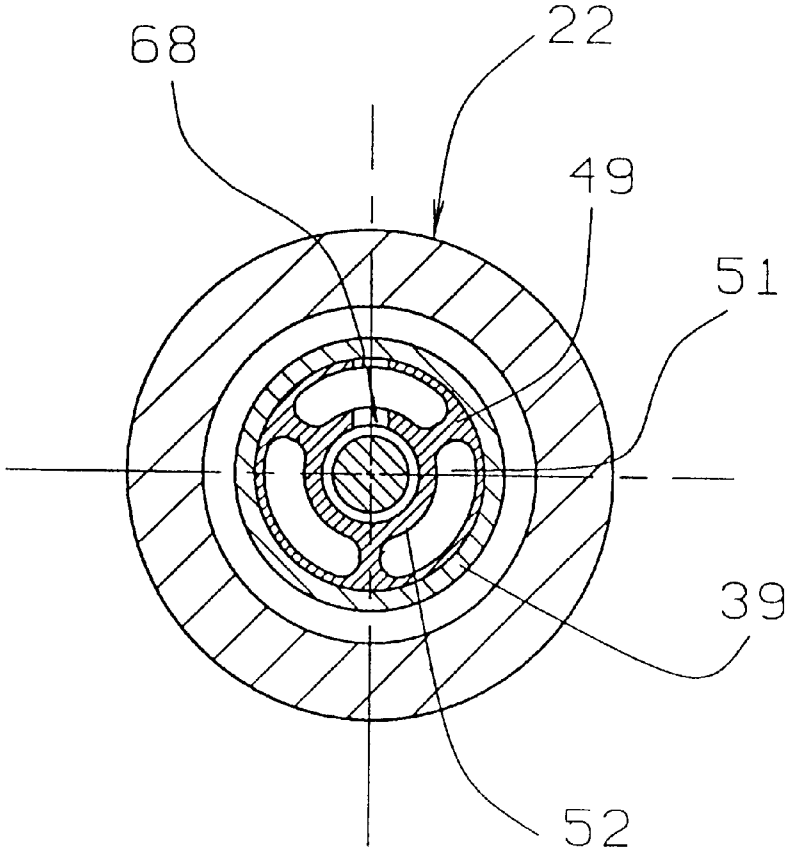
FIG. 5 is a cross-section view taken along line 5—5 of FIG. 1.
Figure 8:
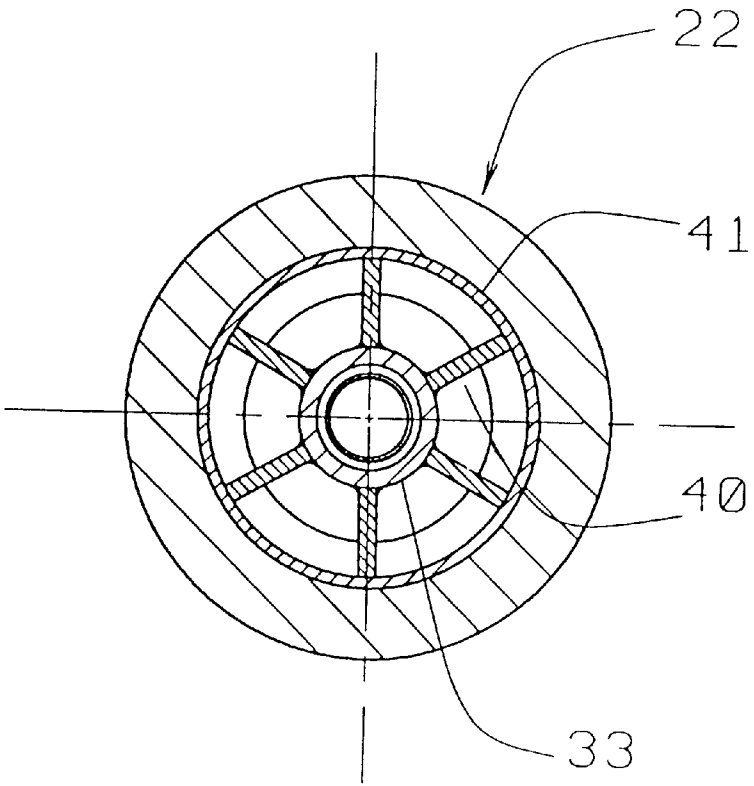
FIG. 8 is a cross-section view taken along line 8—8 of FIG. 1.

It should be noted that length "L" as shown on FIG. 3 and FIG. 4 will determine the total time during which a flow of the drilling fluid is interrupted and the conditions for the water hammer pressure above the closed valve 62 and reduced pressure under the closed valve 62 are present.

Total time during which the valve 62 is kept closed by water hammer pressure is governed by the time that this water-hammer pressure takes to travel to the top of the wash pipe 33 and then through the bypass area down and through the holes 72 and under the closed valve 62, at which point the pressure is equalized under and above the valve 62 thus allowing spring 58 to lift valve 62 to its open position as shown on FIGS. 1–3. This time can be calculated approximately by formula $$(2\times\text{“}L\text{”})/vc=Tc$$

where

"L" is length in feet vc is velocity of sound in ft/sec

Tc is time during which the valve is closed.

Figure 9:
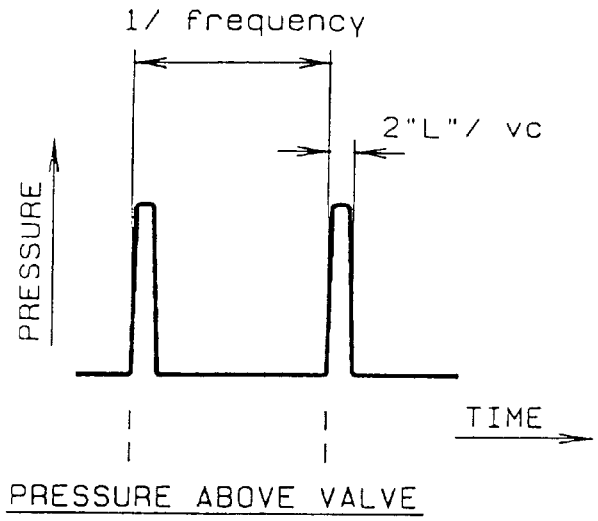
FIG. 9 shows a diagram of the pressure pulse in time above the valve means.
Figure 10:
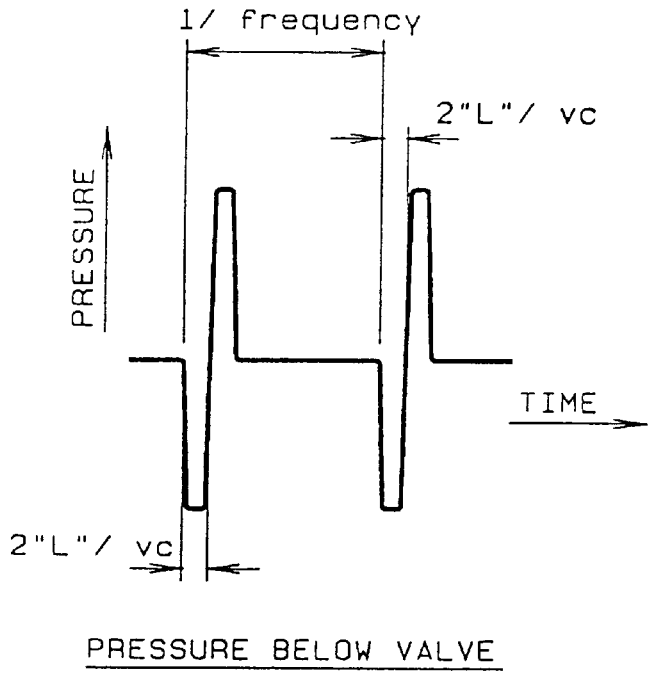
FIG. 10 shows a diagram of the pressure pulse in time below the valve means.

Characteristic of the water hammer pressure pulse above the valve are shown on FIG. 9 while characteristics of the water-hammer pressure pulse below the valve are shown on FIG. 10.

If, during the operation of the valve assembly 46 the spring 58 breaks and the valve 62 remains continually in the closed position flow can be established automatically through the area between the top portion of the wash pipe 33 and into the bypass area 37 downwardly through the holes 72 into the bottom part of the main flow passage 73 and through the drill bit nozzles 26. This feature would allow for a continuous drilling operation without the requirement to pull up the drill string. Active cross-section of the bypass flow is made larger than the main flow area resulting in the requirement for a somewhat lower pressure required to pump through the disabled apparatus. This lower pressure would be registered on the surface and drilling personnel would know that tool is disabled.

Other suggested uses of the invention in the course of the down-hole operations are:

a) shaking of tubing to clean screens;

b) vibrating of cement during cementing operations;

c) pulsating a fluid being pumped into a formation to fracture it;

d) vibrating a fishing jar to free a stuck drill string.

Numerous non-drilling related applications wherein pulsation in a flow of fluid are desired will become apparent to persons skilled in the art of fluid mechanics generally.

Many variations of the flow pulsing apparatus will become apparent to those skilled in the art from the description given above. For definition of the invention reference should be had to the appended claims.

I claim:

1. Apparatus for effecting pulsations in a flow of liquid comprising:

an elongated hollow housing defining a primary flow passage adapted to carry a flow of liquid axially therealong;

an elongated conduit having an upstream end and a downstream end extending within said housing and defining a main flow passage interiorly of said conduit which communicates at its downstream end with said primary flow passage, and a by-pass flow passage extending lengthwise of said conduit from said upstream end to said downstream end thereof;

a nozzle located in said hollow housing adjacent to and spaced from the upstream end of said conduit and adapted to discharge flow passing along said primary passage into said main flow passage defined by said conduit; the space between said nozzle and said upstream end providing communication between said main flow passage and said by-pass flow passage;

an axially movable valve member located in the downstream end of said conduit and co-operating with a valve seat located downstream of said valve member for interrupting the flow through said conduit; there being one or more further passages downstream of said valve seat providing communication between said main flow passage and said by-pass passage in a region downstream of said valve seat;

a spring for urging said valve member toward an open position in the upstream direction; said valve member being adapted to move to a closed position in response to flow along said valve member thus interrupting the flow through said conduit and creating a water hammer pulse which travels upstream through said conduit and said nozzle and also through said space between said nozzle and the upstream end of said conduit whereupon said pulse also travels downstream along said by-pass passage and through said further passage(s) to said region downstream of said valve member thus tending to momentarily equalize water hammer pressures on upstream and downstream sides of said valve member with said spring being adapted to move said valve member away from said seat under these equalized pressures whereupon flow within said conduit again commences thus again effecting the closure of said valve member whereupon the above recited sequence of events is repeated to produce a cyclical water hammer and flow pulsating effect.

2. Apparatus for effecting pulsations in a flow of liquid in accordance with claim 1 wherein said space between said nozzle and said upstream end of said conduit is in the form of an annulus with said nozzle and said upstream end together providing a jet-pump effect and suction on liquid in said by-pass passage.

3. Apparatus for effecting pulsations in a flow of liquid in accordance with claim 1 wherein said valve member is shaped such that fluid flow therealong creates a Bernoulli effect and a pressure loss between upstream and downstream portions of the valve member thus tending to effect said momentary closure against forces exerted by said spring.

4. Apparatus for effecting pulsations in a flow of liquid in accordance with claim 2 wherein said valve member is shaped such that fluid flow therealong creates a Bernoulli effect and a pressure loss between upstream and downstream portions of the valve member thus tending to effect said momentary closure against forces exerted by said spring.

5. Apparatus for effecting pulsations in a flow of liquid in accordance with claim 4 wherein said valve member is mounted for axial reciprocation within a valve housing disposed in said downstream end of said conduit, said spring being a coil tension spring located in said valve housing and secured to said valve member for urging same axially in the upstream direction.

6. Apparatus for effecting pulsations in a flow of liquid in accordance with claim 2 wherein the time said valve member remains closed during each cycle of operation is given approximately by the formula $$T_c=2L/VC$$

where:

L is total length in feet the pulse travels in upstream and downstream directions in each cycle, VC is speed of sound in drilling liquid (ft/sec)

$T_c$ is time valve stays closed per cycle (seconds).

7. Apparatus for effecting pulsations in a flow of liquid in accordance with claim 5 wherein said valve housing and valve member are located in an enlarged diameter downstream portion of said conduit.

8. Apparatus for effecting pulsations in a flow of liquid in accordance with claim 2 wherein said elongated housing is adapted to be fitted into the lower end of a drill string and has threaded connections at its opposing ends for connection between a drill bit and a lower end of a drill string whereby in operation to produce pulsations in a flow of drilling fluid passing through the drill string to the drill bit.

9. A method for effecting pulsations in a flow of liquid comprising:

causing a flow of liquid to travel axially along an elongated hollow housing defining a primary flow passage;

providing an elongated conduit having an upstream end and a downstream end extending within said housing and defining a main flow passage interiorly of said conduit which communicates at its downstream end with said primary flow passage, and a by-pass flow passage extending lengthwise of said conduit from said upstream end to said downstream end thereof;

discharging flow passing along said primary flow passage through a nozzle located in said hollow housing adjacent to and spaced from the upstream end of said conduit and into said main flow passage defined by said conduit; the space between said nozzle and said upstream end providing for communication between said main flow passage and said by-pass flow passage;

interrupting the flow through said conduit by way of an axially movable valve member located in the downstream end of said conduit and co-operating with a valve seat located downstream of said valve member; there being one or more further passages providing communication between said main flow passage and said by-pass passage in a region downstream of said valve seat;

effecting momentary stoppage of the flow within said conduit by means of said valve member moving to a closed position in response to flow and against the force of a spring for urging said valve member toward an open position in the upstream direction thus creating a water hammer pulse which travels upstream through said conduit and said nozzle and also through said space between said nozzle and the upstream end of said conduit whereupon said pulse also travels downstream along said by-pass passage and through said further passage(s) to said region downstream of said valve member thus tending to momentarily equalize water hammer pressures on upstream and downstream sides of said valve member thus permitting said spring to move said valve member away from said seat whereupon flow within said conduit again commences thus again effecting the closure of said valve member whereupon the above recited sequence of events is repeated to produce a cyclical water hammer and flow pulsating effect.

10. A method for effecting pulsations in a flow of liquid in accordance with claim 9 wherein said space between said nozzle and said upstream end of said conduit is in the form of an annulus with said nozzle and said upstream end together providing a jet-pump effect and suction on liquid in said by-pass passage.

11. A method for effecting pulsations in a flow of liquid in accordance with claim 9 including effecting said closure of the flow by creating a Bernoulli effect and a pressure loss between upstream and downstream portions of the valve member thus tending to effect said closure of the flow against the forces exerted by said spring.

12. A method for effecting pulsations in a flow of liquid in accordance with claim 9 wherein the time said valve member remains closed during each cycle of operation is given approximately by the formula $$T_c=2L/VC$$

where:

L is total length in feet the pulse travels in upstream and downstream directions in each cycle, VC is speed of sound in drilling liquid (ft/sec)

$T_c$ is time valve stays closed per cycle (seconds).

13. A method for effecting pulsations in a flow of liquid in accordance with claim 9 wherein said elongated housing is fitted into the lower end of a drill string between a drill bit and a lower end of a drill string whereby in operation pulsations in a flow of drilling fluid passing through the drill string to the drill bit are provided.

* * * * *